US005928088A

United States Patent [19]

Matthews

[11] Patent Number: 5,928,088

[45] Date of Patent: Jul. 27, 1999

[54] GOLF PUTTER HEAD

[76] Inventor: David Paul Matthews, 3601 Crest Rd., Kingsport, Tenn. 37664

[21] Appl. No.: 09/060,135

[22] Filed: Apr. 15, 1998

[51] Int. Cl.[6] ..... A63B 53/04

[52] U.S. Cl. ..... 473/313; 473/330; 473/340

[58] Field of Search ..... 473/330, 331, 473/325, 324, 558, 559, 313, 314, 251, 328, 340; D21/736, 738

[56] References Cited

U.S. PATENT DOCUMENTS

| | | | |
|---|---|---|---|
| 656,099 | 8/1900 | Dunn | 473/330 |
| 1,467,714 | 9/1923 | Doerr | 473/330 |
| 2,789,823 | 4/1957 | Bennett | 473/558 |
| 3,085,804 | 4/1963 | Pieper | 473/325 |
| 4,077,633 | 3/1978 | Studen | 473/340 |
| 4,162,074 | 7/1979 | Thomson | 473/330 |
| 4,453,713 | 6/1984 | Guyer | 473/325 |
| 4,508,342 | 4/1985 | Drake | 473/330 |
| 4,522,405 | 6/1985 | Clawges | 473/340 |
| 4,664,385 | 5/1987 | Macera | 473/340 |
| 4,795,158 | 1/1989 | Kuykendall | 473/340 |
| 5,344,149 | 9/1994 | Miller | 473/340 |
| 5,467,987 | 11/1995 | Perkins | 473/340 |
| 5,857,922 | 1/1999 | Delio | 473/330 |

*Primary Examiner*—Sebastiano Passaniti

[57] ABSTRACT

A golf putter head having a narrow length to minimize side spin and stubbing comprising a striking face with a negative loft and having a center of gravity located above the mid-point of the striking face to provide improved chances of imparting forward roll to a golf ball and to minimize lifting of a golf ball over a putting surface.

1 Claim, 6 Drawing Sheets

GOLF PUTTER HEAD

FIELD OF INVENTION

In the game of golf, there is one playing area called green. In this 'green' (1), there is a hole of four and quarter (4¼) inches in diameter, called 'CUP' (2). A golfer is expected to hit his/her golf ball (3) with a golf club, normally a putter (4), and to get the ball into the cup with least possible number of strokes. This action is called putting. A putter has two key parts, a putter head (5) and a shaft (6). The present invention relates to a design of golf putter head. Implements with which a golf ball is hit are called clubs. These clubs could be grouped into three major groups; namely, woods, irons, and putters. The present invention relates to a design of putter head for a putter.

BACKGROUND OF THE INVENTION

I hypothesize that the most efficient way to get a golf ball in the cup is to have top (forward) spin to the ball. When a golf ball is hit with a currently used putters the following things are happening:

A strike could be at the mid-point or below the mid-point of the ball.

An initial skid of the ball with strike at mid-point and an initial back spin with a strike below the mid-point.

Then the frictional force of the ground stops the skid, back spin, and turns forward momentum imparted by putter into forward rotation of the ball.

Any turning away of the face of the putter head from the intended line would give a side spin to the golf ball (3). And this side spin would take ball away from intended line on which a golfer wants ball to travel.

Then there are contours of the putting surface, and wind direction, if wind is blowing hard.

On a given putting surface (1), slope and its conditions are given; on a given day wind speed and its direction are given, a golfer has no control on these elements. Keeping this in mind the putter head of this invention has design features to reduce side spin, back spin and any tendency to lift the ball and have it to bounce when it drops to the putting surface. It intends to provide an early topspin to provide forward rotation of the ball and less of other three (namely, side spin, backspin and bounce).

FIG. 1 is a perspective view of a golf putter head of this invention.

I have observed many a puts, which have veered away from the intended line of the ball travel even when there were full intentions of hitting along the visualized lines or pathways and the there were no breaks to left or to right from golf ball to the cup.

I have further observed that when a putter (4) is swung as a practice swing, putter strike face (7) remains perpendicular to the path of the swing (FIG. 2). But when a golf ball (3) is actually hit, putter face (7) turns away (FIG. 3) from the intended pathway. This turn of the putter head, how slight it may be, imparts a sidespin to the golf ball. This causes ball to slide away from the intended line, increasing chances of missed putts, some times by a fraction of an inch (or a fraction of a millimeter). Obviously this slide/veer away from the intended line of the direction is more on long puts than on short puts, as ball has to travel more hence it has more distance to slide/veer away from the desired pathway.

Table 1. shows that as the distance of the ball from the cup increases, the angle of the line, that would be tangent to the circumference of the cup, decreases.

TABLE 1

FIG. 4 shows the angles (A) at various distances (L))

| Distance, L from the Center of the Cup, ft | Angle (A) of The Tangent |
|---|---|
| 1 | 10 degrees. |
| 2 | 5 degrees |
| 3 | 3.4 degrees |
| 4 | 2.5 degrees |
| 5 | 2 degrees |
| 6 | 1.01 degrees |
| 7 | 0.67 degrees |
| 20 | 0.5 degrees |

A ball hit one foot from the cup if veers less than 10 degrees, it would be still on a line to the cup, but a ball 10 feet away from the cup even at veer of 1.01 degrees may miss the cup. This shows that as the distance from the cup increases the importance of hitting the ball straight increases.

A search of the prior patents was conducted; the most pertinent patents located are U.S. Pat. No. 5,683,307. Issued to Guerin D. Rife and U.S. Pat. No. 4,077,633 issued to Mr. George Studen.

U.S. Pat. No. 5,683,307 foresees:

'a weight distribution formed by a cavity in the upper surface whereby the predominance of the weight of the head is at the heel, toe and bottom portions thereof. This weight configuration is combined with a ball striking face having a loft no greater than three degrees. The weight distribution, acting to lift the ball when it is struck, eliminates the need for a more lofted ball striking face.'

U.S. Pat. No. 4,077,633 foresees:

". . . A golf ball striking face on the head" being "divided into two contiguous transverse face segments, the lower of which is slanted downwardly and backward at about 1–7 degrees, "and the upper of which is slanted upwardly and backwardly at about" 1–3 degrees. It further envisions a non-planar, obtuse angle configuration for the ball striking face and contact being envisioned preferably along the intersection between two contiguous transverse face segments mentioned.

A golf club (woods or irons) strike should cause ball to rise. However, my hypothesis is that if any lift is given to the golf ball (3) on putting surface, one loses control on the direction of the ball (FIG. 5). We are at the mercy of the side spin and bounce of the ball when it drops on the putting surface. A bounce slight to the left or slight to the right of the intended pathway; and we lose control on the direction. It takes so little to miss a putt! The golf putter head of this invention, in most of the putting strokes would strike the golf ball above the mid-point (8) of the ball (FIG. 6), thus providing no back spin or any lift to the ball over the putting surface.

A normal putting stroke moves the putter head parallel to the putting surface. Due to the negative loft (13) of the strike face (7) of the putter head of this invention, such a stroke would create contact above the mid-point (8) of the ball (3) (FIG. 6). However, for longer puts, one may end up hitting the ball with an up-swing, plus strange things do happen in the game of golf. FIG. 7 shows that as long as the upswing is less than the negative loft (13), the contact or strike point would be above the mid-point of the ball.

Edges of the putter head (heel (17) to toe (18)) provide an imaginary band (12) within which we want our golf ball to stay on a putting surface without any break to left or to right (FIG. 3) and to drop in the cup. I have observed that this imaginary band (12) is too wide with current putters in use, and any break from the band by the golf ball is more than likely to result in a missed putt. FIG. 9 shows that a shorter length putter head (5) provides easier visualization of a narrower band (12) or pathway to the cup (2) from the golf ball resting point.

Putting is a fine art of 'read' (direction, a golfer wants golf ball to take) and 'speed' (distance, a golfer wants golf ball to go). Often, a golfer gets so focused on the 'read' that the golfer forgets that the putter head is wide and hinged at an awkward point. A little carelessness and golfer ends up hitting ground with a part of putter before putter face hits the ball. This is called 'stubbing' the putter. With stubbing golfer loses 'speed' (distance). Many a puts (even short ones) have been missed due to stubbing.

SUMMARY OF THE INVENTION

Golf putter head (5) of this invention is machined (investment casting or forged) from a solid rectangular piece of metal with a hosel (9) for a shaft (6) connection.

FIG. 1 is a perspective view of the golf putter head of this invention, which imparts reduced side spin, provides contact with golf ball at points which minimize chances of lifting the ball, provides contact points with the ball that provides forward rotation, provides narrower imaginary band for the golf balls pathways and reduces chances of stubbing the putter head.

Side spin: To avoid side spin due to the rotation of the putter head (5), an optimum design length of the putter head would be a very narrow head (FIG. 8) (5). But a very narrow head (5) would have some practical problems for most of the golfers except some young ones who have sharp eyesight and steel steady hands. With most of golfers a very narrow putter head would end up slipping and sliding on golf ball surface. Current putters in use have a head length in the range of about four inches. The putter head of the invention has a shorter length: one point six (1.6") inches to three (3.0) inches. Compared to currently used putter, this invention putter head would have a smaller radius from the ball and putter head contact point to the edge of heel (17) or toe (18) of the putter head. This would reduce the turning of the putter head and reduce side spin to golf balls hit.

Golf Ball Lift & Forward Rotation: Strike face of the putter head (5) of the invention has a negative loft angle (13) of ten (10 ) to thirty (30) degrees (FIG. 6). This would promote putter head contact with the golf ball above mid-point (8) or at the mid-point thus virtually eliminating lifting of the ball with normal putter swing; which is more of a swing parallel to the ground than a up-down-up swing of other golf clubs.

FIG. 6 shows that the strike face height (16) is larger than the height of the back (14); this moves the center of gravity upwards. Other golf clubs (woods and irons), head designs attempt to bring center of gravity down to get the ball up in the air. But I feel lifting the ball while putting we lose control on the direction. With a higher center of gravity for this invention putter head, we further reduce chances of getting ball up above the putting surface. With the putter head of this invention with its negative loft, and higher center of gravity, a golf ball would stay low and roll on the putting surface.

Narrower band of vision (12) for the pathway of the golf ball. Shorter length of the putter head makes it easier to visualize narrower band; and this imaginary band would be within diameter of the cup (4¼ inches). This would forgive some sidespin and some veering away from the visualized band and still be within the cup's diameter (FIG. 9).

Stubbing Putter head of this invention with its narrower strike face length (10) provides less of putter length to stub toe or heel. FIG. 10 shows the smoothly curved bottom (15) from heel (17) to toe (18). These curves minimize chances of stubbing a putter head.

DESCRIPTION OF THE PREFERRED EMBODIMENT

FIGS. 1,6, 7, 10, and 11 show the golf putter head of this invention.

Figure 9:
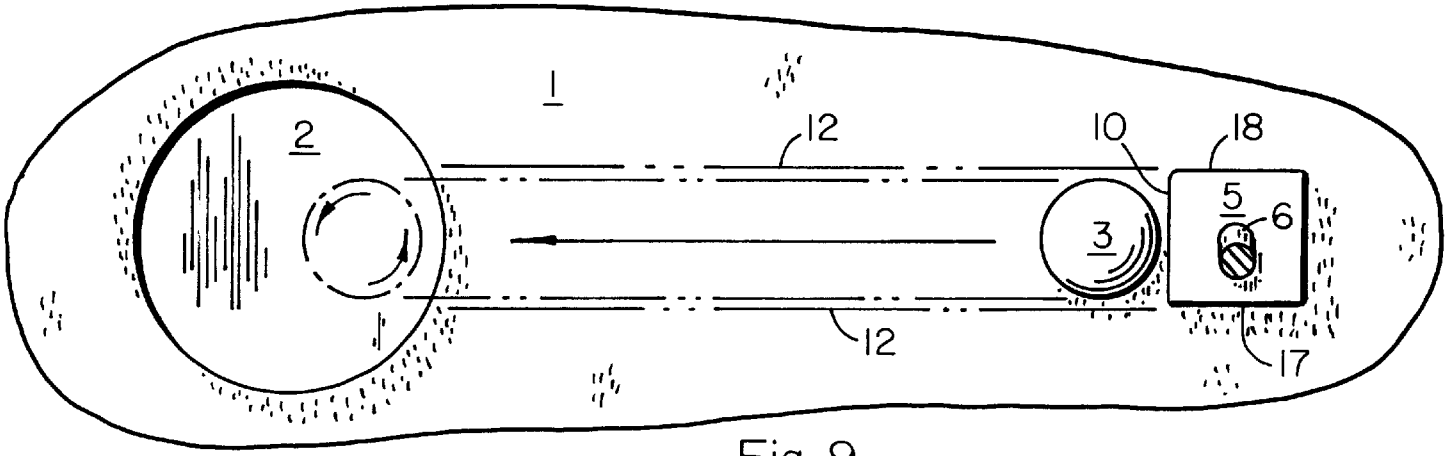
FIG. 9 Showing an imaginary pathway of this invention putter head, and an imaginary pathway to the cup.

FIG. 9 shows that putter head length (10) is narrower which brings heel (17) and toe (18) of the putter closer to center of gravity. In case of a golf ball and putter contact point not being at the exact center of gravity, since heel and toe are not far apart, this contact point would not be very far off the center of gravity. Given this, there would be a minimal turn of the putter face from the intended line, and the corresponding reduced side spin of the golf ball.

An added value of the shorter length of putter head is that it helps to visualize a narrower pathway (12) to the putting hole (2) than the diameter of the cup FIG. 9. This narrowness would forgive some side spin movement of the golf ball and still keep the golf ball direction which would allow it to drop into the cup if it has the right distance.

Figure 1:
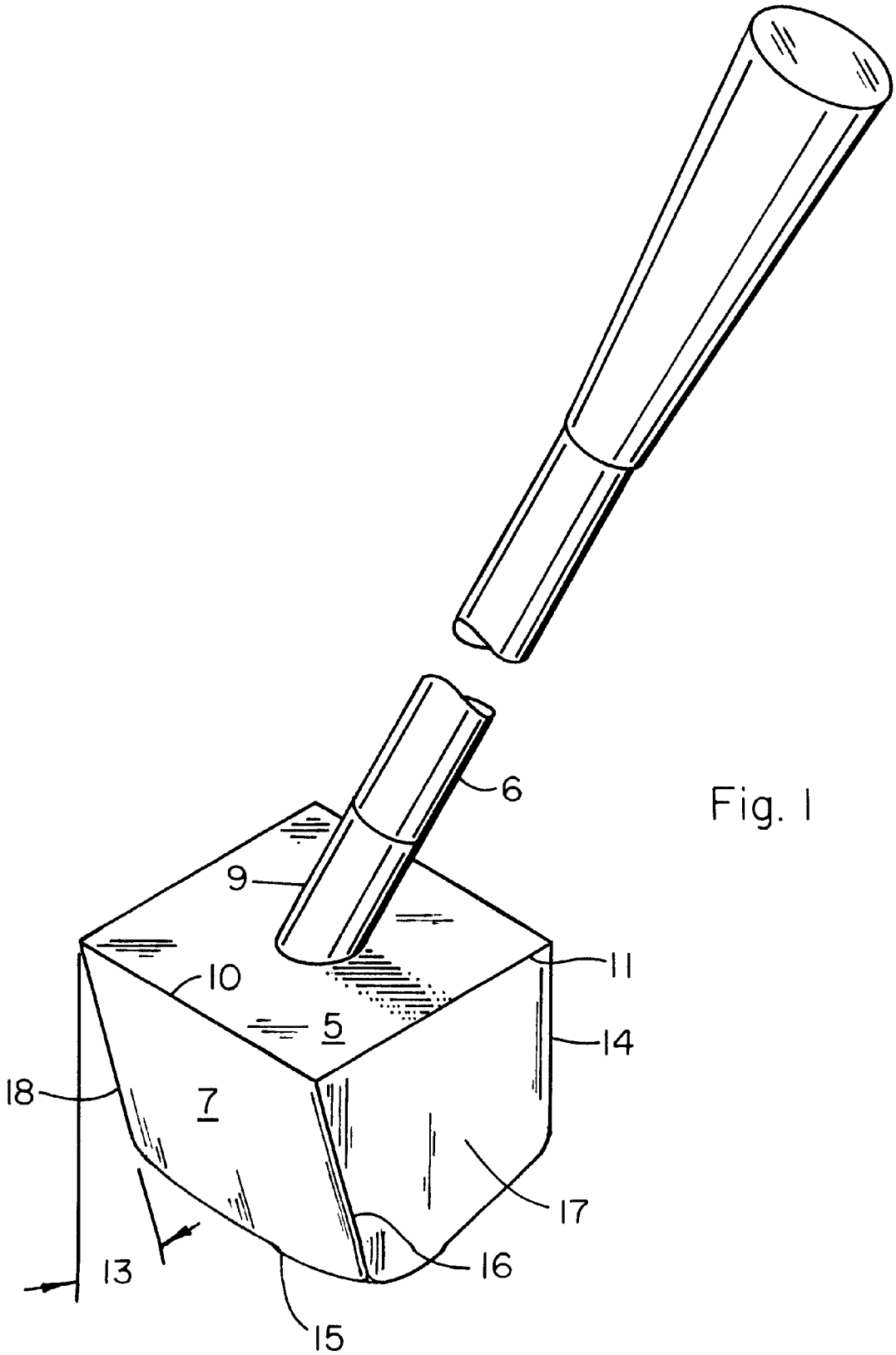
FIG. 1 A perspective view of the putter head of this invention.
Figure 2:
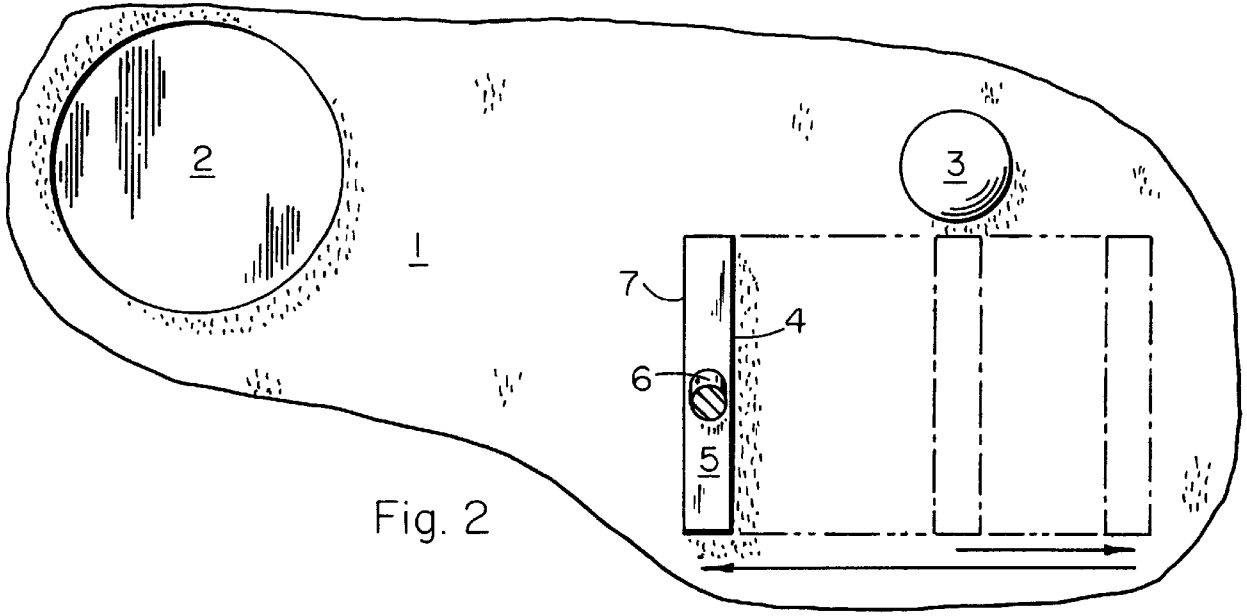
FIG. 2 A practice swing pathway of a putter head.
Figure 3:
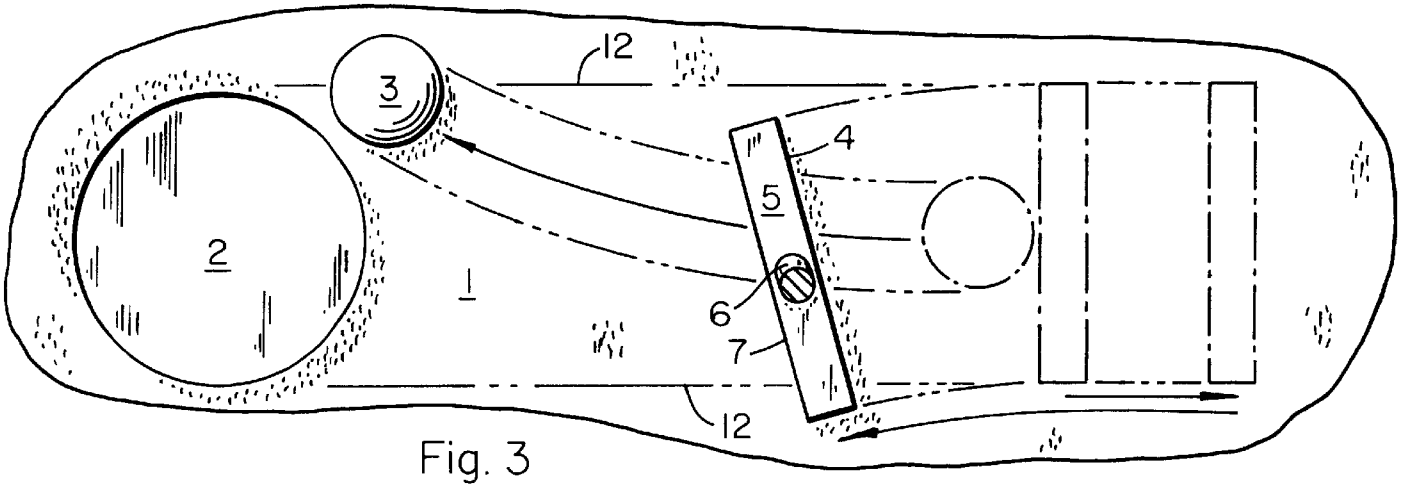
FIG. 3 Most likely ending of the current putter heads after striking a golf ball.
Figure 4:
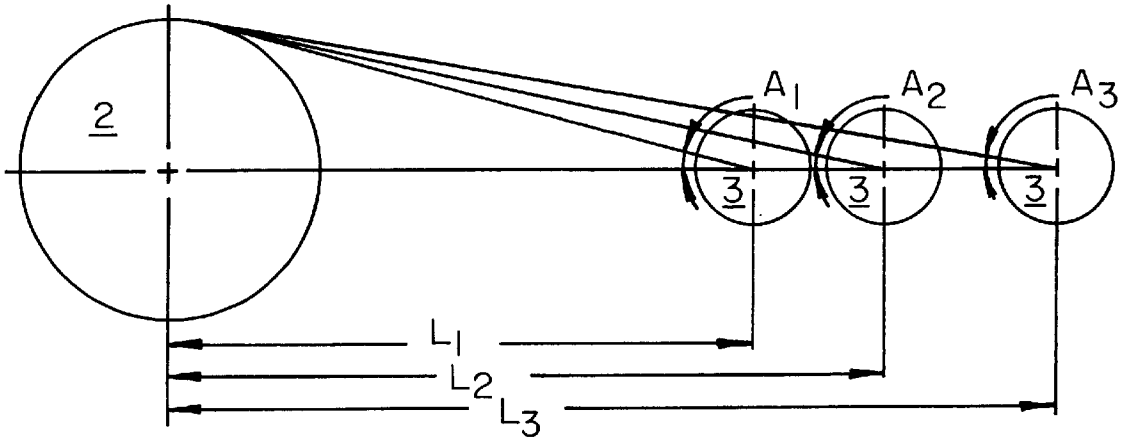
FIG. 4 Angles of tangents from ball points to the radius of the cup.
Figure 5:
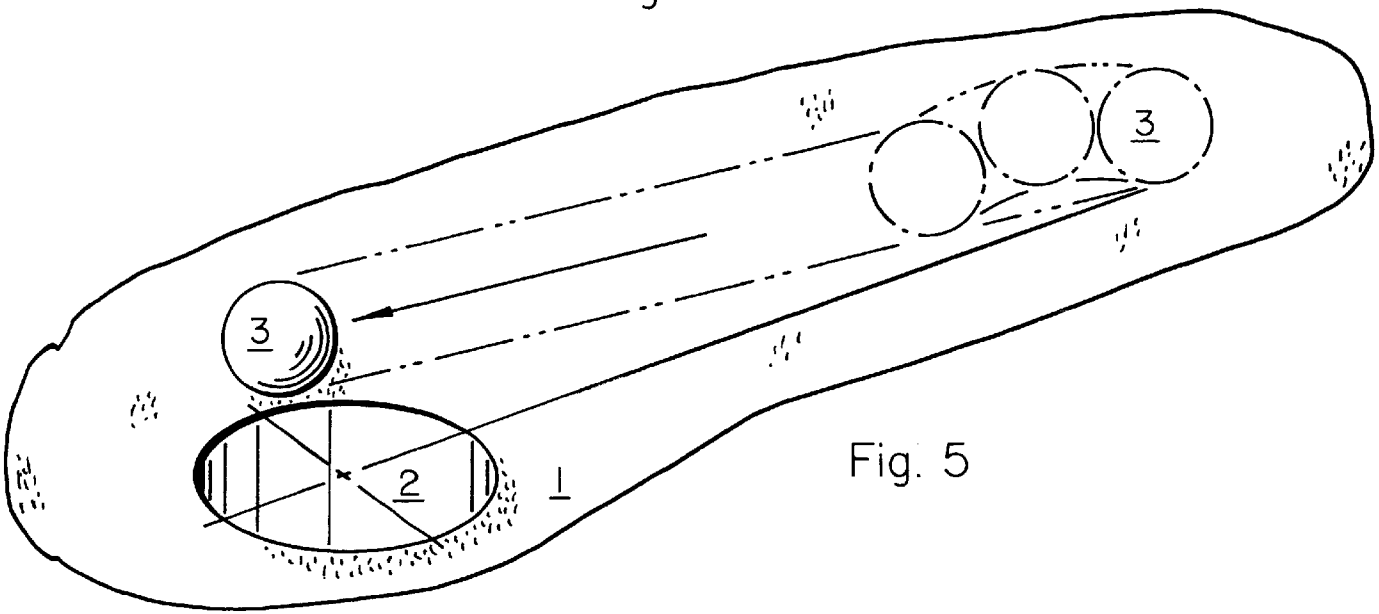
FIG. 5 Hitting of golf ball below mid-point and its rise in the air.
Figure 6:
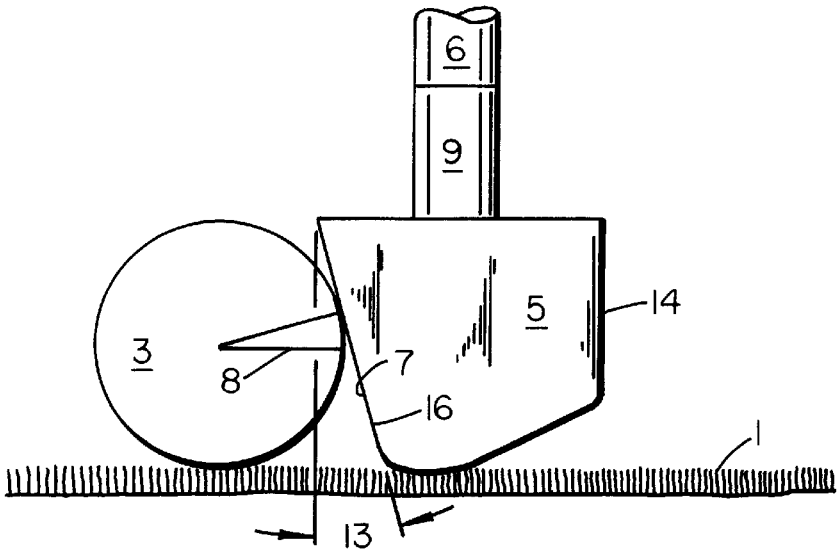
FIG. 6 Showing possible strike point of the present invention putter head.
Figure 7:
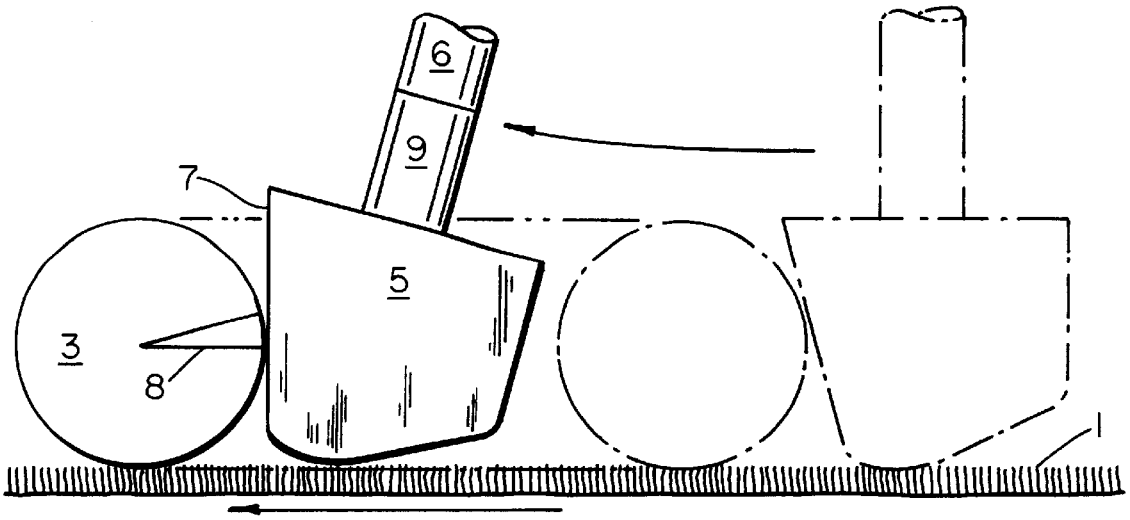
FIG. 7 A pendulum swing of the putter showing an up-swing angle.
Figure 8:
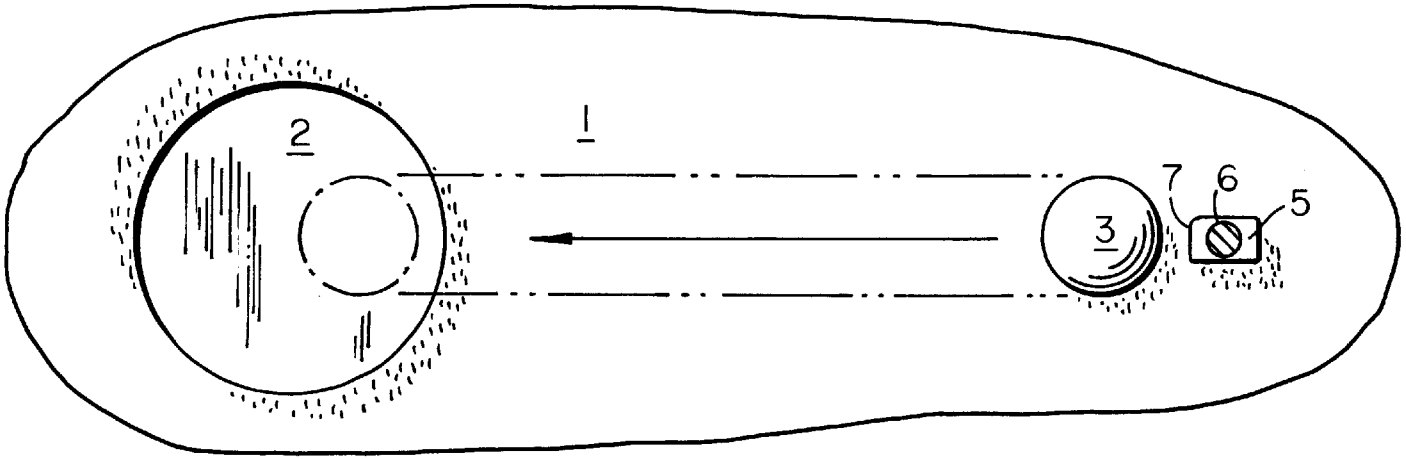
FIG. 8 Golf ball and a very narrow putter head.

FIG. 6 shows the negative loft (13) of the putter strike face (7), this design makes it easier to avoid lifting the golf ball (3) above the putting surface (1). A putter head swing parallel or slightly curving up should strike at the mid-point (8) of the ball or slightly above the mid-point thus avoiding lifting of the ball, if there is no intention to raise the ball above the putting surface. For longer puts, a golfers strive to hit harder, and I have observed that when golfers try to hit long puts, golfers tend to hit at an up-swing of a pendulum FIG. 7. However with a negative loft of 10 degrees or more, even at an up-swing the strike face (7) of the putter head of the invention would strike above or at the mid-point (8) of the golf ball (FIG. 7).

FIG. 6 also shows an initial flatter bottom then curving up to back face, and the shorter height (14) of the back compared to the height (16) the strike face (7).

Figure 10:
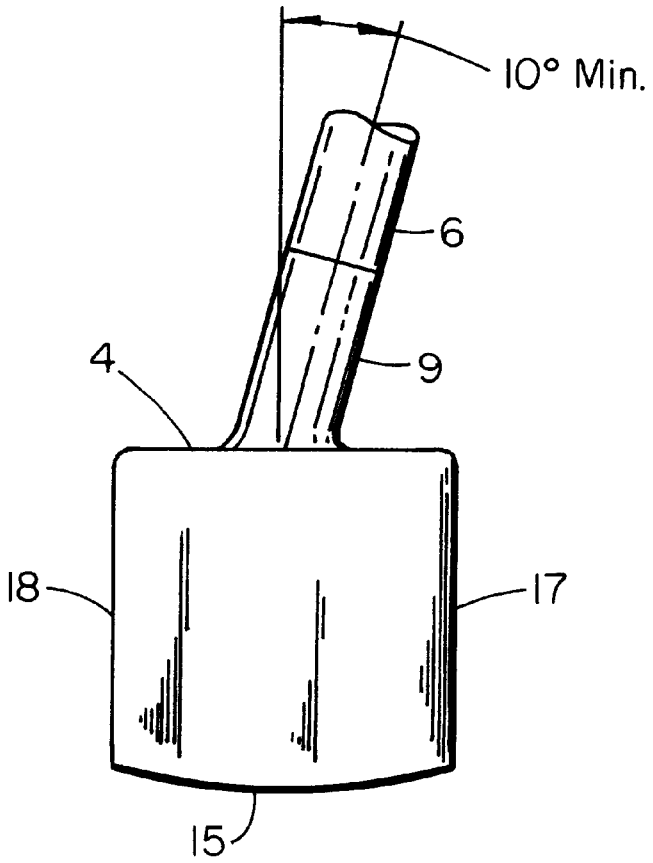
FIG. 10 Front view of this invention putter head showing curved sole (bottom).

FIG. 10 shows curved bottom of the putter head from heel (17) to toe (18).

Figure 11:
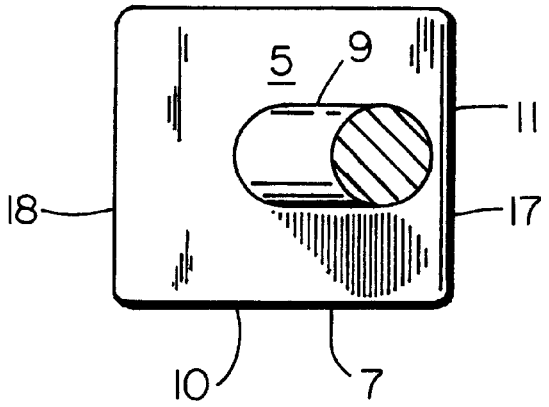
FIG. 11 View of this invention putter head from the top.

FIG. 11 shows the view of the putter head as seen from the top. This shows that the hosel (9) link is more central than favoring either heel (17) or toe (18). This makes it for a balanced hold of the putter. Combine this with the narrowness of the putter head, and results are reduced chances of stubbing at heel or toe of the putter. It further shows that the strike face length (10) is longer than front to back distance (11).

I claim:

1. A golf putter head adapted for attachment to a golf club shaft comprising:

a club body having a front striking face, a top surface, a bottom surface, a back, a heel, and a toe;

said top surface including a substantially straight hosel inclined a minimum of 10 degrees from a vertical plane passing through said striking face and said back for attaching said putter head to a golf club shaft; said hosel being located substantially centrally on said top surface between said heel and said toe and substantially centrally between said front striking surface and said back;

said front striking face having a negative loft of between 10 to 30 degrees with respect to a vertical plane passing through said heel and said toe;

said bottom surface being smoothly curved from said heel to said toe; said bottom surface extending rearwardly about midway between said front striking face and said back to form a generally flat surface and thereafter continuing rearwardly in an upward fashion toward said back; whereby a portion of said bottom is raised when said hosel is oriented in a vertical plane passing through said heel and said toe;

whereby, when said putter head is viewed from said heel end with said hosel aligned vertically, the vertical height of said striking face measured from said top surface downwardly toward said bottom surface is less than the vertical height of said back measured from said top surface downwardly toward the raised portion of said bottom.

* * * * *